343-700 MS AU 251 FX
7/2/85 OR 4,527,163

United States Patent [19]

Stanton

[11] Patent Number: 4,527,163

[45] Date of Patent: Jul. 2, 1985

[54] OMNIDIRECTIONAL, CIRCULARLY POLARIZED, CYLINDRICAL MICROSTRIP ANTENNA

[75] Inventor: Philip H. Stanton, Los Angeles, Calif.

[73] Assignee: California Institute of Technology, Pasadena, Calif.

[21] Appl. No.: 482,464

[22] Filed: Apr. 6, 1983

[51] Int. Cl.[3] ..... H01Q 1/38; H01Q 9/18

[52] U.S. Cl. ..... 343/700 MS; 343/791

[58] Field of Search ..... 343/700 MS, 790, 791, 343/792, 829, 900

[56] References Cited

U.S. PATENT DOCUMENTS

| | | | |
|---|---|---|---|
| Re. 29,296 | 7/1977 | Krutsinger et al. | 343/700 MS |
| 4,204,212 | 5/1980 | Sindoris et al. | 343/700 MS |
| 4,323,900 | 4/1982 | Krall et al. | 343/700 MS |

OTHER PUBLICATIONS

A. D. Krall, J. M. McCorkle, John E. Scarzello and A. M. Syelles, "The Omni Microstrip Antenna: A New Small Antenna," IEEE Transactions on Antennas and Propagation, vol. AP-27, Nov. 1979, pp. 850–853.

G. H. Brown and O. M. Woodward, Jr., "Circularly-Polarized Omnidirectional Antenna," RCA Review, Jun. 1947, pp. 259–269.

Robert E. Munson, "Conformal Microstrip Antennas and Microstrip Phased Arrays," IEEE Transactions on Antennas and Propagation, vol. AP-22, Jan. 1974, pp. 74–78.

K. R. Carver and J. W. Mink, "Microstrip Antenna Technology," IEEE Transactions on Antennas and Propagation, vol. AP-29, No. 1, Jan. 1981, pp. 13–16.

*Primary Examiner*—Eli Lieberman

*Attorney, Agent, or Firm*—Freilich, Hornbaker, Rosen & Fernandez

[57] ABSTRACT

A microstrip cylindrical antenna comprised of two concentric subelements on a ground cylinder, a vertically polarized (E-field parallel to the axis of the antenna cylinder) subelement on the inside and a horizontally polarized (E-field perpendicular to the axis) subelement on the outside. The vertical subelement is a "wraparound" microstrip radiator. A Y-shaped microstrip patch configuration is used for the horizontally polarized radiator that is wrapped 1.5 times to provide radiating edges on opposite sides of the cylindrical antenna for improved azimuthal pattern uniformity. When these subelements are so fed that their far fields are equal in amplitude and phased 90° from each other, a circularly polarized EM wave results. By stacking a plurality of like antenna elements on the ground cylinder, a linear phased array antenna is provided that can be beam steered to the desired elevation angle.

7 Claims, 12 Drawing Figures

ELEMENT, ELEVATION RADIATION PATTERN - AMPLITUDE

VERTICALLY POLARIZED SUBELEMENT AZIMUTHAL RADIATION PATTERN - AMPLITUDE

VERTICALLY POLARIZED SUBELEMENT AZIMUTHAL RADIATION PATTERN - PHASE

VERTICALLY POLARIZED SUBELEMENT ELEVATION RADIATION PATTERN - AMPLITUDE

HORIZONTALLY POLARIZED SUBELEMENT AZIMUTHAL RADIATION PATTERN - AMPLITUDE

HORIZONTALLY POLARIZED SUBELEMENT AZIMUTHAL RADIATION PATTERN - PHASE

HORIZONTALLY POLARIZED SUBELEMENT ELEVATION RADIATION PATTERN - AMPLITUDE

OMNIDIRECTIONAL, CIRCULARLY POLARIZED, CYLINDRICAL MICROSTRIP ANTENNA

ORIGIN OF INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to a circularly polarized antenna for ground mobile vehicle communication with a satellite, and more particularly to a microstrip antenna.

Major components of a conventional terrestrial mobile radio system are the base station and the transmitting tower. Simply stated, telephone calls are routed to the mobile users by "broadcasting" the voice channels from the transmitter (or a repeater) over a given radius. The base station serves as the interface between the mobile telephone system and the regular telephone network thus permitting the mobile user to access any telephone in the country. Frequencies used by these systems are typically in the following bands: 30–44 MHz, 152–162 MHz, and 450–460 MHz.

Although conceptually simple from a frequency channel standpoint, such systems suffer from a number of technical difficulties. To begin with, the mobile user must stay in the coverage area (line-of-sight) of the base station or one of its repeaters. A more severe shortcoming, however, is its wasteful use of the precious little spectrum allocated to this service. Note that since the voice channels are broadcast over the entire coverage area, any one channel cannot simultaneously be used by more than one user, thus limiting the size of the market the system can address. To overcome these difficulties, a new concept called a cellular mobile radio system is under development.

The cellular mobile system under development and field experimentation will correct most of the deficiencies associated with conventional systems. In a cellular system, the entire coverage area, for example, a major city and its suburbs, is divided into a number of cells, each with its own base station and frequency band. Cellular systems operate in the 806–890 MHz band. The frequency reuse concept is used to increase the utility of the available frequency spectrum. The total allocated band is divided into 3 sub-bands designated A, B, and C, with each sub-band being assigned to a cell such that no cell is adjacent to a cell of the same sub-band. This insures that the transmissions in one cell do not interfere with the independent transmissions in the adjacent cells. However, through power control and geographical separation, the frequency sub-bands are reused in non-adjacent cells thereby providing efficient use of the available spectrum. In this way, any given frequency channel can be used in hundreds of separate geographic locations unlike the older broad coverage systems.

When a vehicle roams from one geographical cell to another, the mobile unit's frequencies are automatically changed to a new set, compatible with the base station in that cell. The control and interconnection with the wireline network is handled by the mobile telephone switching office (MTSO).

In addition to the frequency reuse aspect, the other major feature of the cellular system is the different cell sizes accommodating varying user population densities. For example, the larger cells might represent less populated suburban areas while the smaller cells represent the more densely populated urban areas. Should the market in any given cell increase, the cell can be further subdivided into smaller cells to accommodate the increased traffic. These smaller cells represent a greater reuse of the available spectrum, this providing more channels for the same coverage region.

A cellular mobile system in the Washington-Baltimore area is operated by American Radio Telephone (ART), for which Motorola is manufacturing the mobile equipment, and another the Advanced Mobile System (AMPS), in the Chicago area, is operated by the Bell System.

As sophisticated as the cellular mobile radio-telephone concept is, the fact remains that such a system may not provide coverage to the nonurban areas of the country. A geostationary satellite, on the other hand, is ideally suited for providing communication to virtually any geographic region, no matter how remote.

Conceptually, the satellite system is analogous to the cellular radiotelephone systems in design and similar in operation. For a geographic service area such as the continguous 48 states, the satellite antenna produces a number of contiguous beams whose circular footprints cover the entire service area. These circular footprints nominally represent the −3 dB contours to the beam patterns. Frequency sub-bands are assigned to each beam as in the cellular case with no adjacent beams assigned to the same sub-band. In the design proposed in a Land Mobile Satellite Service (LMSS) there are 87 such beams covering the 48 contiguous states.

The LMSS system is equivalent to the cellular system in that the beam footprints are equivalent to the cells, the satellite is equivalent to remote repeaters for each cell, and the ground base stations within the beam footprints serve to the same function as base stations in the cellular systems, that is, control and wireline network interconnection.

Communicating through a geostationary satellite requires a mobile antenna which has a radiation pattern of relatively high gain in the direction of the satellite and low gain in the direction of the interfering signals, such as from terrestrial communications systems. One way of achieving this is to have a pencil-beam antenna which tracks the satellite position, either mechanically or electronically. Continuous beam steering for general mobile applications is too voluminous and/or expensive.

Another approach is to use an antenna which has an omnidirectional azimuthal and narrow vertical radiation pattern, with its peak gain at the satellite elevation angle. This type of antenna allows the vehicle to change directions without the need to adjust the beam pointing and still have good gain discrimination between the satellite and other elevation angles.

The LMSS satellite uses a circularly polarized antenna to avoid polarization changes in the EM wave, due to Faraday rotation by the ionosphere. A mobile antenna of matching polarization is desirable, but this is difficult to obtain in a single antenna capable of covering elevations from near the horizon to over 60° above the horizon. A small aperture antenna, such as crossed drooping dipoles or planar microstrip patch radiator may be adequate for elevation angles above 20° but for angles below this a vertical array or a quadrifilar helix would be more satisfactory. The more versatile of these seems to be a vertical array of circularly polarized elements which can readily be phased to steer the beam elevation angle.

In an effort to fulfill the requirements of a land mobile/satellite communication link for the LMSS, an omnidirectional, circularly polarized, microstrip antenna element has been invented for automotive use. This element has a thin profile (approximately $\lambda_o/12$, where $\lambda_o$ is the freespace RF wavelength) and can be stacked to form a linear array.

SUMMARY OF THE INVENTION

The omnidirectional circularly polarized cylindrical microstrip antenna of the present invention is comprised of two concentric subelements supported by a vertical conductive ground cylinder and isolated by dielectric cylinders, a vertically polarized (E-field parallel to the axis of the antenna cylinder) radiator on the inside and a horizontally polarized (E-field perpendicular to the axix) radiator on the outside. The inner radiator, a vertically-polarized, half-wave resonant is comprised of a conductive cylinder of resonant length, completely around (360°) a dielectric cylinder which is concentric with the vertical conductive ground cylinder. The outer radiator, a horizontally-polarized, half-wave resonant conductor is comprised of a conductive sheet of resonant length wrapped around a concentric dielectric cylinder with at least one vertical radiation edge between its ends parallel to the axis of the ground cylinder. In order to reduce the circumference of the ground cylinder to significantly less than the resonant length of the conductive sheet for the outer element, the sheet is preferably in the form of a block Y shape such that it may be wrapped one and a half times around its supporting dielectric cylinder with the tail between the parallel arms. This provides one radiator at the edge of the tail diametrically opposite two radiators at the edges of the arms. By extending the length of the conductive ground cylinder, additional antenna elements may be provided in a linear stack. Coaxial feed lines to the microstrip radiators pass through the wall of the ground cylinder to the appropriate subelements. The subelements of each antenna element are so fed that their fields are equal in amplitude and phased 90° from each other in order to produce a circularly polarized electromagnetic wave in the far field. By adding a third subelement like the second subelement but of slightly greater resonant half wave length, with its diametrically opposite radiating edges aligned with those of the second subelement, an antenna element with two resonant frequency bands is achieved.

The novel features of the invention are set forth with particularity in the appended claims. The invention will best be understood from the following description when read in connection with the accompanying drawings.

DESCRIPTION OF PREFERRED EMBODIMENTS

Figure 1:
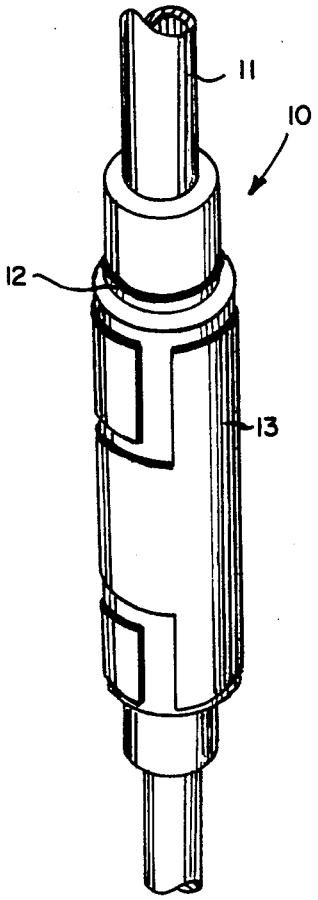
FIG. 1 is a perspective view of an omnidirectional, circularly polarized cylindrical microstrip antenna element in accordance with the invention.

Referring now to the drawings, FIG. 1 illustrates a microstrip cylindrical antenna element 10 supported on an electrically conductive ground cylinder 11 consisting of, for example, a brass tube. The antenna element consists of two conductors 12 and 13 of different configurations wrapped around the ground cylinder, and separated from each other, and from the ground cylinder, by respective dielectric cylinders 14 and 15 which may be solid materials, gas or free space. The inner conductor 12 forms a vertically polarized subelement, and the outer conductor 13 forms a horizontally polarized subelement.

Figure 2:
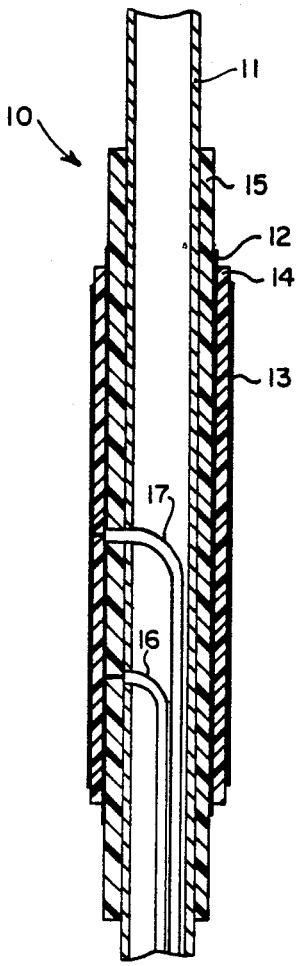
FIG. 2 is a longitudinal cross-section of the antenna element shown in FIG. 1.

These subelements are separately fed through coaxial cables 16 and 17 passed through the ground cylinder, as shown in FIG. 2. The subelements are fed such that their far fields are substantially equal and phased 90° to produce a circularly polarized electromagnetic wave in the far field.

Figure 3:
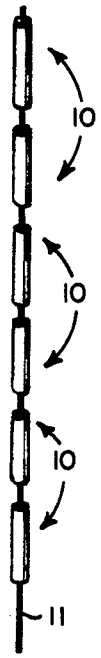
FIG. 3 illustrates a plurality of antenna elements stacked on a ground conductive cylinder common to all elements, where each is formed as shown in FIG. 1.

A plurality of these antenna elements may be stacked on the ground cylinder to form a linear array, as shown in FIG. 3. By phasing these elements relative to each other, the antenna beam may be steered to the optimum elevation angle for the position of the satellite in any particular geographic area, for example to an elevation angle of about 30°. While the beam could be steered to higher elevation angles, such as about 40° or higher, other types of antennas suitable for such high elevation angles would be used in those geographic areas where the satellite is about 22° above the horizon, which is expected to be generally the southern half or two thirds of the United States, e.g., crossed drooping dipoles and planar microstrip radiators.

This microstrip antenna element may be compared to other types of omnidirectional, circularly polarized antennas for land mobile use such as: four inclined dipoles or "Lindenblad" antenna, circularly polarized biconical horn, four axial helixes on a cylinder, slotted cylinder dipole and backfire quadrifilar helix. The first three of these antennas would have rather large profiles for mobile applications, especially for narrow elevation beamwidths, the vertical length of the slotted cylinder dipole element is too long for a versatile phase array (limited beam steering). The quadrifilar helix is not readily beam steerable. This microstrip element, on the other hand, is relatively small, easily stacked into a phase steerable array and is polarization switchable. The stacked elements provide an omnidirectional, circularly polarized, phased array antenna, which adequately covers the low elevation angle range of 10° to 22° (or 3° to 29° including vehicle tilt).

Figure 4:
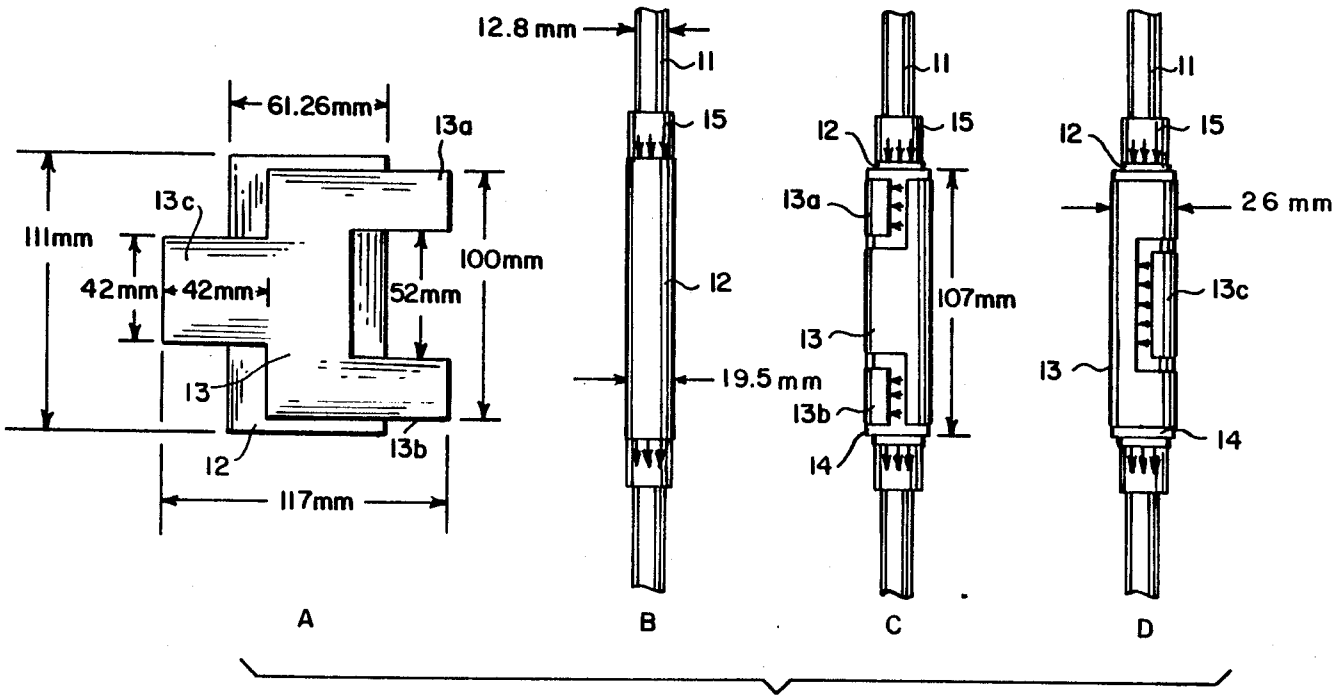
FIG. 4A illustrates microstrip patches for the antenna element of FIG. 1.
FIG. 4B illustrates the vertically polarized subelement.
FIG. 4C illustrates the horizontally polarized subelement (double radiating edge side)
FIG. 4D illustrates the horizontally polarized subelement (single radiating edge side).

FIGS. 4A through 4D illustrate the construction of the circularly polarized antenna element of FIG. 1 starting with two microstrip patches identified by the same reference numerals 12*a* and 13*a* as for the subelements referred to with reference to FIGS. 1 and 2. The patch 12 is a rectangular copper foil of sufficient width to wrap completely around a cylindrical layer of dielectric 15 formed on the ground cylinder, as shown in FIG. 4B, and of half-wave resonant length in the dielectric to form a half-wave resonant cylinder. The small arrows at the two ends of the wrapped patch 12 in FIG. 4B indicate what appears to be its primary radiating edges and approximate E-field polarization.

The patch 13 for the second subelement is Y-shaped with a half-wave resonant length in the dielectric from the edges at the ends of the parallel arms 13*a* and 13*b* to the edge at the end of the tail 13*c*. This resonant length is greater than the circumference of its insulating cylinder 14 of dielectric material formed over the subelement 12, so that the tail 13*c* fits between the arms 13*a* and 13*b*, leaving a vertical radiating edge at the end of the tail as shown in FIG. 4D and radiating edges at the end of the arms as shown in FIG. 4C. The small arrows indicate what appear to be the primary radiating edges and approximate E-field polarization of the subelement 13. It should be noted that the vertically polarized subelement 12, which is a conductive cylinder, is used as the ground cylinder for the horizontally polarized subelement.

It would be desirable to make the diameter of ground cylinder 11 as small as possible in order that the overall diameter of the antenna element 10 be small, typically $\lambda_o/12$, where $\lambda_o$ is the free space wavelength. The length of the vertically polarized subelement is less than $\lambda_o/2$ (because of a shorter wavelength in the dielectric material), but of sufficient length for the subelement 12 to function as a half-wave resonant conductor. The dimensions of the Y-shaped patch for the horizontally polarized subelement are preferably chosen to provide a half-wave resonant conductor that will wrap one and one-half times around. In that way the out-of-phase radiating edges of the Y-shaped patch will be on opposite sides of the cylinder. By having a smaller circumference cylinder and out-of-phase radiating edges on opposite sides, a more uniform azimuthal amplitude and phase pattern is achieved.

An omnidirectional, circularly polarized, microstrip antenna element was constructed and impedance matched for a center frequency of 954.23 MHz. The element construction used a brass tube for the ground cylinder, polytetrafluoroethylene for the dielectric, and copper foil for the conductive patches. The dimensions of this exemplary element are shown in FIG. 4A. Two coaxial feed lines were routed through the interior of the ground cylinder, as shown in FIG. 2. The outer conductor of the coaxial feed line 16 is connected to the ground cylinder and the inner conductor is connected to the vertical radiating patch 12. The outer conductor of the coaxial feed line 17 is connected to the center of the vertical patch conductor and the center conductor is connected to the horizontal radiating patch. Impedance matching was accomplished by the positioning of the feeds on the radiating patches. The vertical and horizontal radiator feed lines, of proper relative electrical length, were interconnected by means of a power splitter/combiner (not shown). The feed points and the power fed to the vertical and horizontal subelements are adjusted such that their far field amplitudes are substantially equal, and their relative phase is adjusted so that the phase difference between the vertical and horizontal fields is 90°. The result was a circularly polarized antenna element having an overall diameter of approximately $\lambda_o/12$ and length less than $\lambda_o/2$.

Preliminary test measurements were performed on this antenna element, and both its vertical and horizontal subelements. It was treated as a prototype and not optimized; therefore, the following results are probably short of its full potential. The measurements consisted of return loss ($\rho$) vs frequency, relative power vs azimuth, relative phase vs azimuth (subelements only) and relative power vs elevation. The patterns shown in FIGS. 5 through 12 have been redrawn for better reproduction, but are reasonable facsimiles of the original patterns plotted from measurements made.

The return loss measurements on a typical vertical subelement yielded rather broad bandwidths (~10% for a VSWR≦2:1) for a thin microstrip antenna. The horizontal subelement return loss bandwidth is much narrower, generally in the one percent range. The performance requirements for a typical system and the impedance measurement results, obtained when the vertical and horizontal subelements were combined in the circularly polarized antenna elements, are given in the following Table I and II for the total antenna, and impedance measurements for the vertical and horizontal subelements (the element not under test being terminated in a 50Ω lead) in the following Table III.

TABLE I

| | |
|---|---|
| Performance Requirements for a Typical System The LMSS may include Alaska and Canada in its coverage, therefore, the following requirements are listed for the mobile antenna: | |
| (A) Radiation Pattern | |
| Azimuth | omnidirectional |
| Elevation | Peak Gain of ≧ 5 dBic from 10° → 22° elevation angles (±7° for vehicle tilt, resulting in an effective elevation angle of 3° → 29°) |
| (B) Operating Frequencies | |
| Transmit | 821 → 831 MHz |
| Receive | 866 → 876 MHz |
| (C) Polarization | Circular |
| (C) Mechanical | physically compatible with a mobile environment |

TABLE II

| Return Loss ($\rho$) of a Circular Polarized, Prototype Element | |
|---|---|
| Freq. (MHz) | $\rho$(dB) |
| 948.27 | 12 |
| 954.23 | ~22 |
| 958.08 | 12 |

TABLE III

| Typical Return Loss (ρ) for the Vertical and the Horizontal Subelements | | |
|---|---|---|
| Freq. (MHz) | Vertical Subelement ρ(dB) | Horizontal Subelement ρ(dB) |
| 946. | ~11. | ~10. |
| 949. | ~11. | ~50. |
| 951. | ~11. | ~10. |

Figure 5:
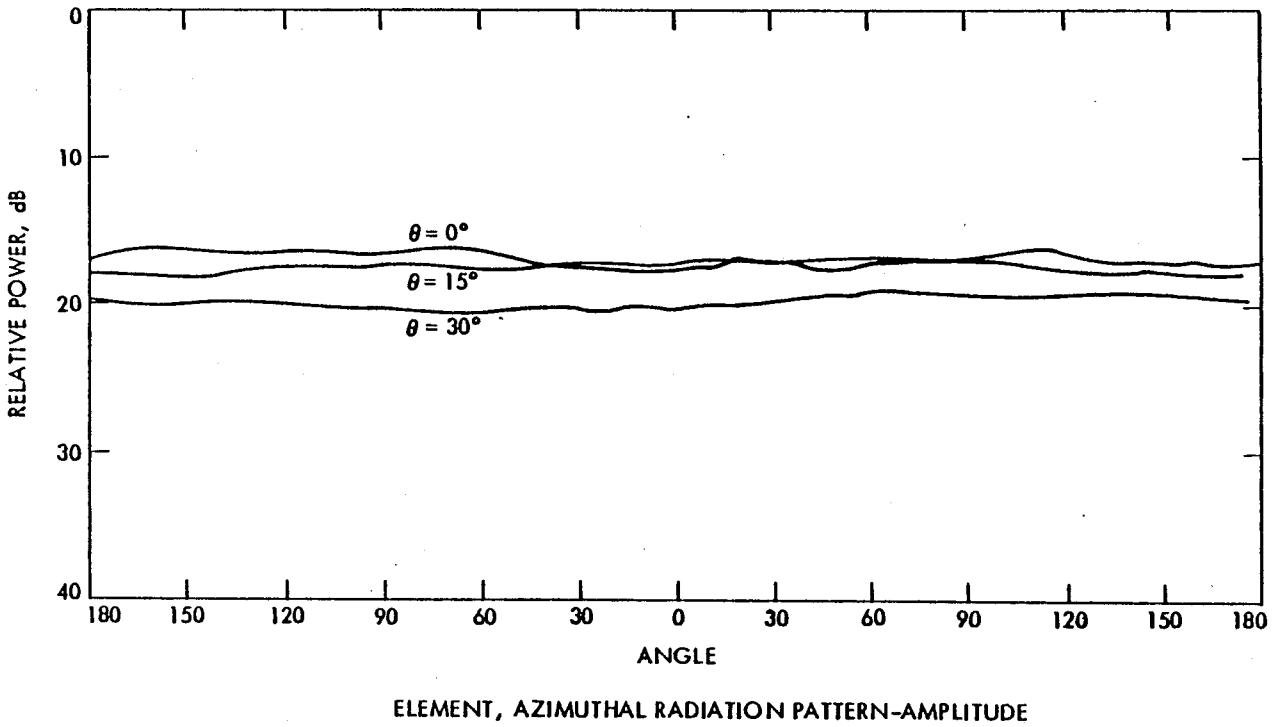
FIG. 5 is a graph of the azimuthal radiation power pattern for the antenna element of FIG. 1.
Figure 6:
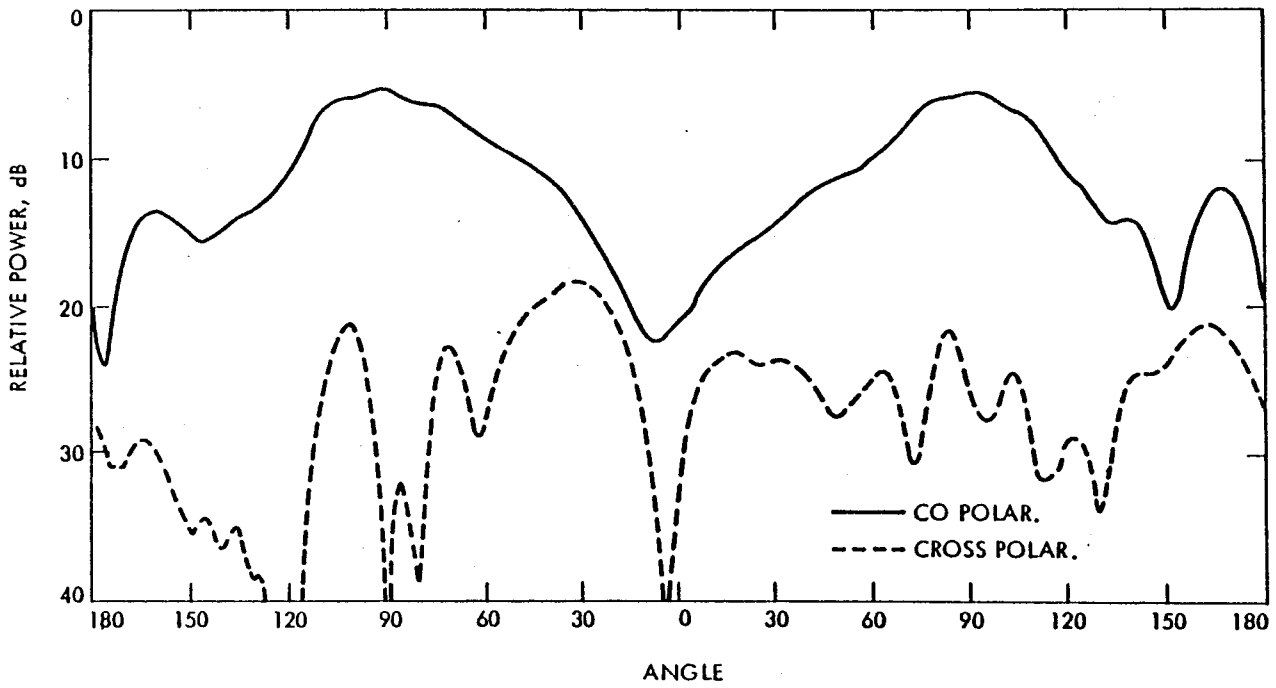
FIG. 6 is a graph of the elevation radiation power pattern for the antenna element of FIG. 1.
Figure 7:
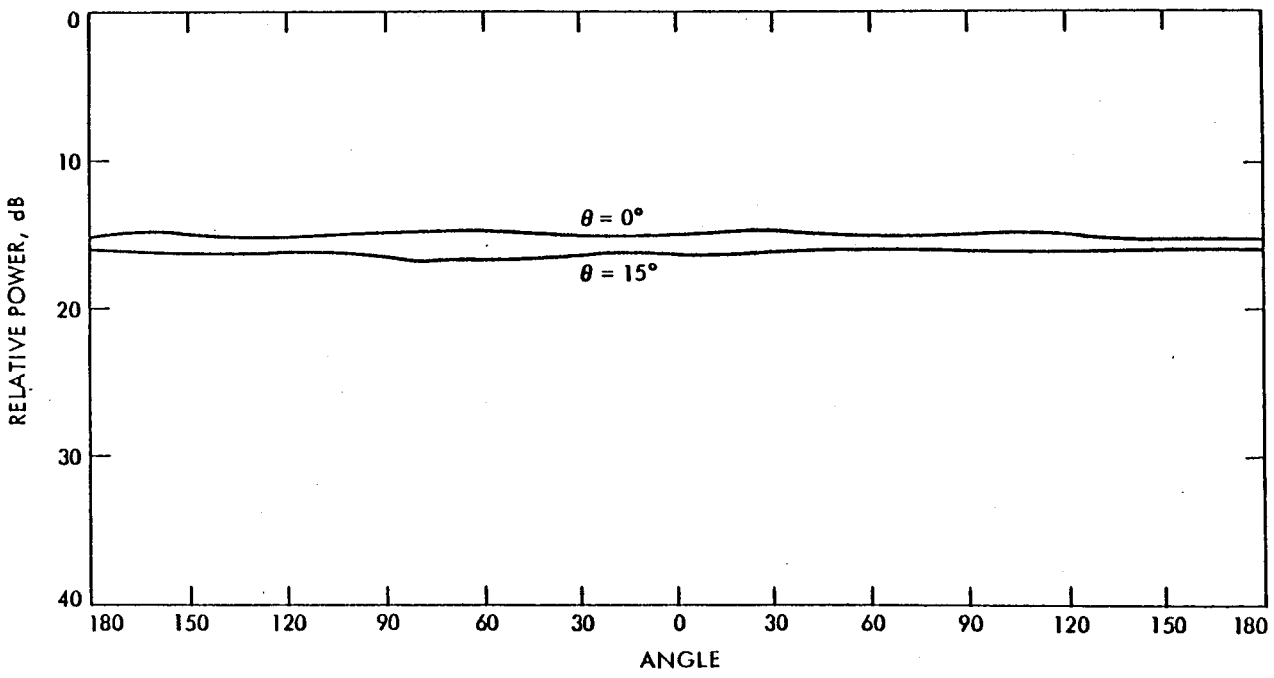
FIGS. 7 and 8 are graphs of the azimuthal radiation power and phase pattern for the vertically polarized subelement of the antenna element of FIG. 1.
Figure 8:
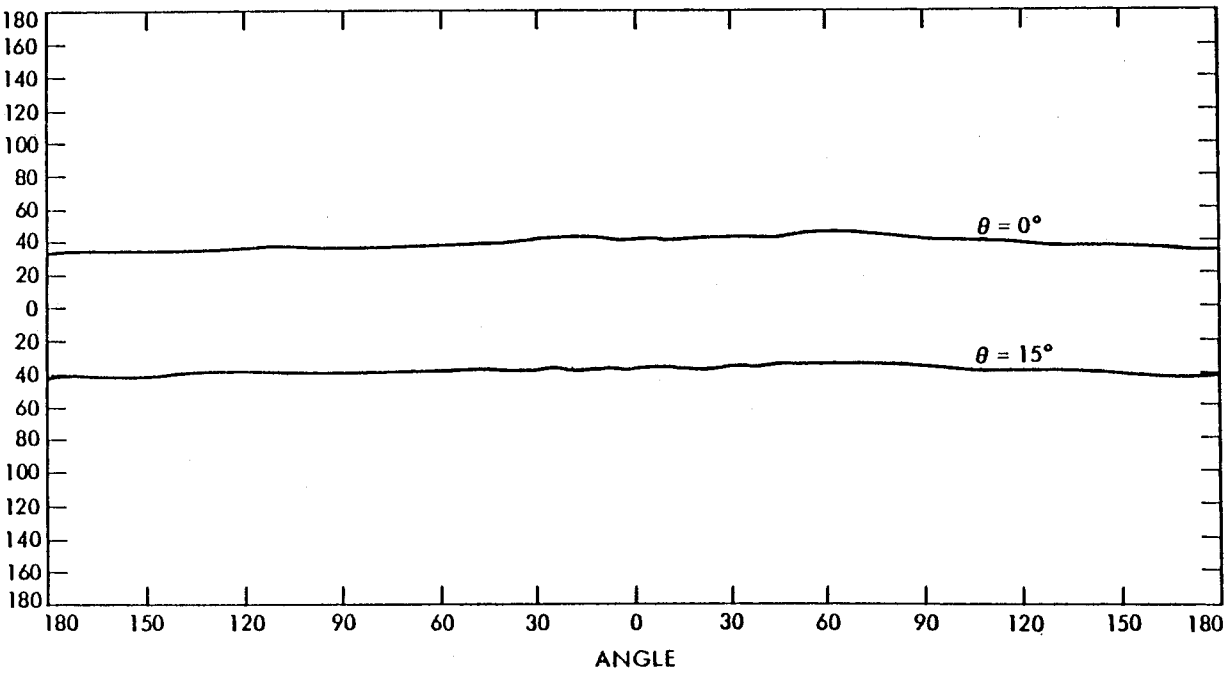
Figure 9:
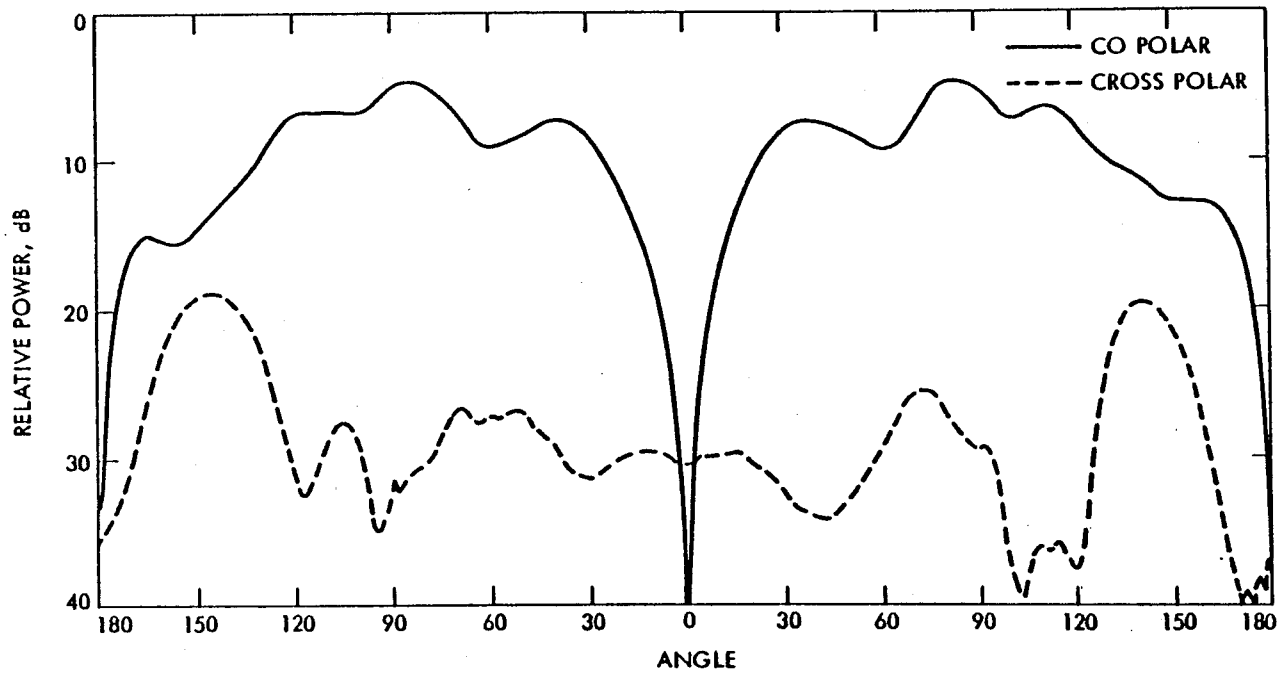
FIG. 9 is a graph of the elevation radiation power pattern for the vertically polarized subelement of the antenna element of FIG. 1.
Figure 10:
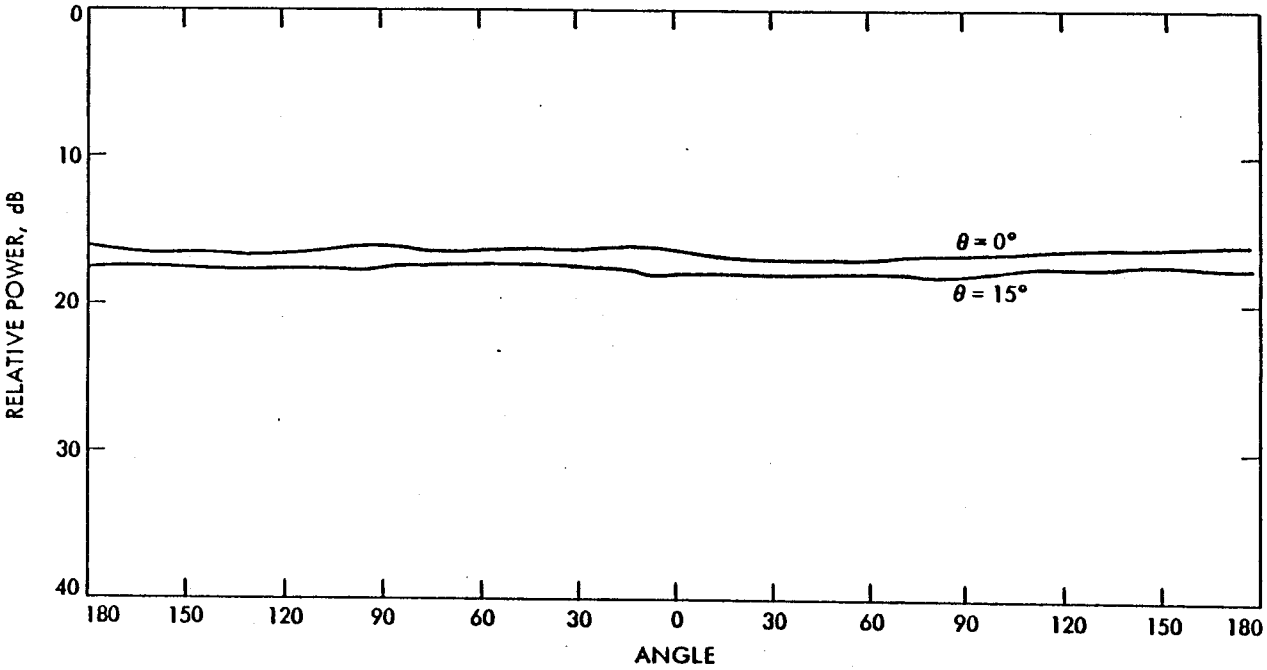
FIGS. 10 and 11 are graphs of the azimuthal radiation power and phase patterns, respectively, of the horizontally polarized subelement of the antenna element of FIG. 1.
Figure 11:
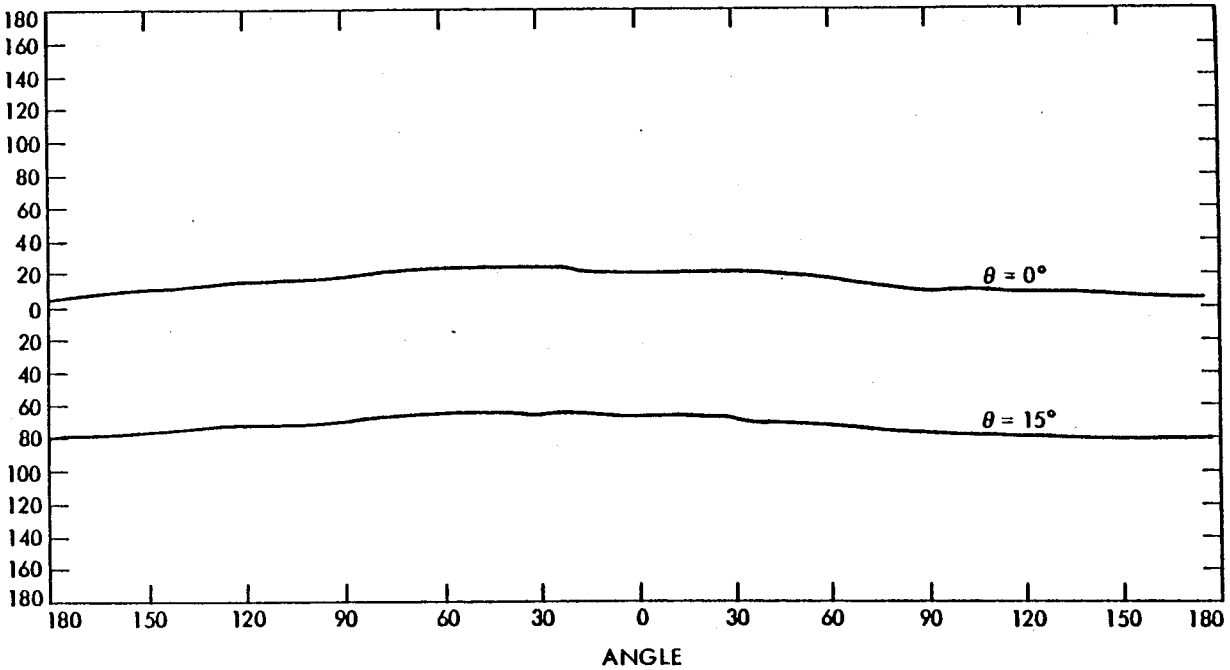
Figure 12:
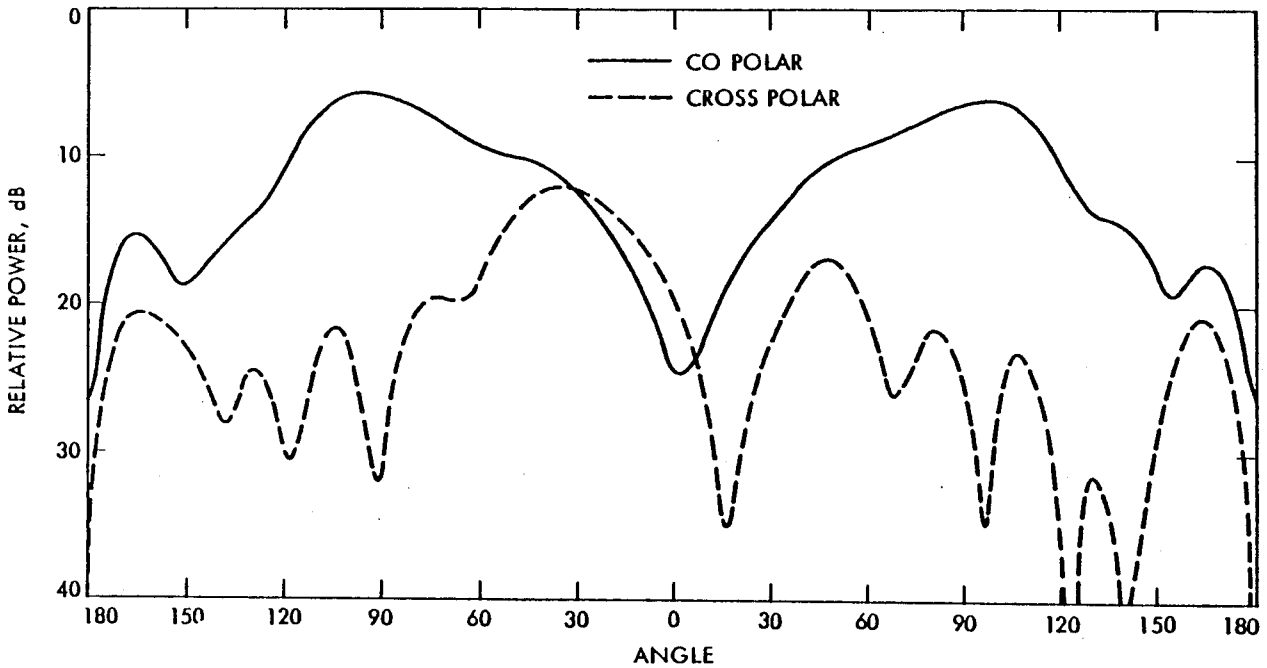
FIG. 12 is a graph of the elevation power pattern for the horizontally polarized subelement of the antenna element of FIG. 1.

The azimuthal radiation patterns of the circularly polarized element plotted in FIG. 5 show a relative power variation of $\leqq \pm 0.8$ dB. The elevation patterns plotted in FIG. 6 show a 3 dB beamwidth of ~50° and a cross polarized component, near broadside, ~16 dB below the peak copolarized component. The vertical subelement's azimuthal radiation patterns plotted in FIGS. 7 and 8 show power variations of $< \pm 0.5$ dB and phase variations of $< \pm 6°$. The elevation patterns plotted in FIG. 9 show a ripple in the copolar component which may be explained by diffraction from the finite length ($\sim 3\lambda_o$) ground cylinder. The cross polarized component, near broadside, is ~20 dB below the peak copolarized component. The horizontal subelement's azimuthal patterns, FIGS. 10 and 11, have a variation in power of $< \pm 0.5$ dB and a phase variation of $\leqq \pm 9°$. Its elevation patterns, FIG. 12, show a 3 dB beamwidth of ~54° and a cross polarized component, near broadside, of ~14 dB below the peak copolarized component. Finally, the gain of the circularly polarized antenna element was measured at approximately 0 dBic.

A deficiency noted in this omnidirectional antenna element for the LMSS application is in its impedance bandwidth, which is approximately wide enough to cover the transmit or receive frequency band, but not both. The most promising way to overcome this deficiency is to apply dual resonance techniques. In one such technique, an additional transmission line is attached to a radiating edge of a microstrip radiator and is terminated at a certain line length in either an open or short circuit. This results in two bandwidths, spaced some frequency apart (depending on line length and termination) one for transmitting and one for receiving, where the impedance is matched to that of the feed line. Another technique, with similar results, involves adding another antenna element which resonates at a slightly offset frequency from the original element. This may be done on the same ground cylinder, and possibly with a third subelement similar to the second subelement over the second subelement element with its radiating edges aligned with the radiating edges of the second subelement. Owing to the larger outside diameter of the dielectric cylinder supporting the microstrip patch for the third subelement, its half-wave resonant length may be slightly greater than that of the second subelement. The third subelement will thus resonate at a slightly offset frequency from the second subelement.

Once the electrical performance of one antenna element has been optimized for a particular application, a phased, coaxial array of five elements can be stacked (with approximately 6 dBic gain and 23° beamwidth) and tested for mutual coupling of elements, impedance bandwidth, pattern bandwidth, radiation patterns and beam steering capabilities in order to prepare adequate specifications for use.

The omnidirectional, circularly polarized, microstrip radiating element described herein has potential in a number of applications by virtue of its small cross-section (approximately $\lambda_o/12$), reasonable length (less than $\lambda_o/2$), polarization diversity (left-hand circular or right-hand circular by simple switching), ease in arraying and the ability to be electronically or manually beam steered. Potential applications include mobile terminals for communication and position finding links with terrestrial or satellite systems, such as land vehicles, aircraft and small boats.

Although particular embodiments of the invention have been described and illustrated herein, it is recognized that modifications and equivalents may readily occur to those skilled in the art, particularly in the selection of materials and the methods of fabrication to be employed. For example, the microstrip patches may be etched in copper films produced on the dielectric cylinders. Consequently, it is intended that the claims be interpreted to cover such modifications and equivalents.

What is claimed is:

1. An omnidirectional, circularly polarized, antenna having at least one element comprising two concentric half-wave resonant subelements supported by a vertical conductive ground cylinder, one of said subelements being comprised of a conductive cylinder of half-wave resonant length separated from said ground cylinder by a dielectric cylinder, and the other of said subelements being comprised of a conductive sheet of half-wave resonant length, said conductive sheet being wrapped around said first subelement and separated therefrom by a dielectric cylinder, with at least two vertical radiating edges of said sheet, and means for feeding said subelements such that their far fields are subsequently equal and phased 90° from each other to produce a circularly polarized electromagnetic wave in the far field.

2. An omnidirectional antenna element as defined in claim 1, wherein said conductive sheet of half-wave resonant length is Y-shaped, with the tail disposed between parallel arms thereof.

3. An omnidirectional antenna element as defined in claim 2 wherein the circumference of said wrapped sheet is one third the resonant half-wave length of said wrapped sheet, whereby said sheet wraps one and one-half times around said vertically polarized subelement to place the radiating edge at said tail at the opposite side of said horizontally polarized subelement from the radiating edges of said arms.

4. An omnidirectional antenna as defined in claim 3 wherein said conductive cylinder of said vertically polarized subelement is comprised of a copper foil wrapped around a dielectric cylinder supported by said ground cylinder, and said horizontally polarized subelement is comprised of a copper foil wrapped around a dielectric cylinder supported by vertically polarized subelement.

5. An omnidirectional antenna as defined in claim 1 having a plurality of like antenna elements stacked on said ground cylinder to form a linear phased array antenna for beam steering to the desired elevation angle thereof.

6. An omnidirectional antenna comprised of at least one antenna element on a hollow conductive ground cylinder of a diameter about $\lambda_o/12$, where $\lambda_o$ is the wavelength in free space of the signal to be transmitted or received, said antenna element having at least two microstrip subelements, a first subelement comprised of a dielectric cylinder concentric with said ground cylinder and a conductive sheet completely around said dielectric cylinder to form a conductive cylinder of half-wave resonant length in said dielectric, and a second subelement comprised of a second dielectric cylinder concentric with said dielectric cylinder and conductive cylinder of said first element, and a conductive sheet in a block Y shape of sufficient length to wrap one and one half times around said second dielectric cylinder with the tail between the arms thereof, said sheet having a length from the edge of the tail to the edge of the arms of half-wave resonant length in said dielectric.

7. An omnidirectional antenna as defined in claim 6 comprised of a plurality of like antenna elements stacked on said ground cylinder to form a linear phased array antenna for beam steering to the desired elevation angle.

* * * * *

UNITED STATES PATENT AND TRADEMARK OFFICE

CERTIFICATE OF CORRECTION

PATENT NO. : 4,527,163

DATED : July 2, 1985

INVENTOR(S) : Philip H. Stanton

It is certified that error appears in the above-identified patent and that said Letters Patent are hereby corrected as shown below:

Column 2, line 28, after "contours" delete "to" and substitute - - of - -

Claim 3, line 45, after "edges" delete "of" and substitute - - at - -

Signed and Sealed this

*Seventh* Day of *January 1986*

[SEAL]

*Attest:*

DONALD J. QUIGG

*Attesting Officer*

*Commissioner of Patents and Trademarks*